US008672656B2

(12) United States Patent
Guidry, Jr.

(10) Patent No.: US 8,672,656 B2
(45) Date of Patent: Mar. 18, 2014

(54) PROGRESSING CAVITY PUMP/MOTOR

(75) Inventor: Michael J. Guidry, Jr., Hockley, TX (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 263 days.

(21) Appl. No.: 12/973,482

(22) Filed: Dec. 20, 2010

(65) Prior Publication Data

US 2012/0156078 A1 Jun. 21, 2012

(51) Int. Cl.
*F01C 1/22* (2006.01)
*F04C 2/08* (2006.01)
*F04C 2/107* (2006.01)

(52) U.S. Cl.
CPC ..... *F01C 1/22* (2013.01); *F04C 2/1075* (2013.01)
USPC ..... 418/178; 418/154; 418/155; 418/179; 418/201.1

(58) Field of Classification Search
CPC ..... F04C 2/1075
USPC ..... 418/152, 201.1, 48, 153, 154, 155, 178, 418/179; 29/888.023; 415/72, 73; 175/107
See application file for complete search history.

(56) References Cited

U.S. PATENT DOCUMENTS

| | | | | |
|---|---|---|---|---|
| 2,983,512 | A * | 5/1961 | Fleischer | 473/568 |
| 4,029,443 | A | 6/1977 | Burnside et al. | |
| 4,313,717 | A | 2/1982 | Kopecky | |
| 5,474,432 | A | 12/1995 | Hulley et al. | |
| 6,309,195 | B1 | 10/2001 | Bottos et al. | |
| 7,083,401 | B2 | 8/2006 | Hooper | |
| 7,131,827 | B2 | 11/2006 | Jager et al. | |
| 7,192,260 | B2 | 3/2007 | Lievestro et al. | |
| 7,407,372 | B2 * | 8/2008 | Guidry et al. | 418/48 |
| 8,033,802 | B2 * | 10/2011 | Tekneyan et al. | 418/48 |
| 2013/0149182 | A1 * | 6/2013 | Sreshta et al. | 418/178 |

* cited by examiner

*Primary Examiner* — Thomas Denion
*Assistant Examiner* — Laert Dounis
(74) *Attorney, Agent, or Firm* — Streets & Steele; Patrick K. Steele; Jeffrey L. Streets

(57) ABSTRACT

A progressing cavity pump/motor (10) includes a stator housing (12), a polymeric layer (14), and a rotor (16). A plurality of axially extending grooves (24) are formed in the interior surface of the stator housing for receiving polymeric material therein. At least one seal gland (46) adjacent an end of the polymeric layer maintains sealing between the stator housing and the polymeric layer.

16 Claims, 6 Drawing Sheets

PROGRESSING CAVITY PUMP/MOTOR

FIELD OF THE INVENTION

The present invention relates to progressing cavity pumps and motors, and more particularly relates to improvements in downhole progressing cavity pumps or motors which facilitate reliable operation at relatively high temperatures and/or pressures.

BACKGROUND OF THE INVENTION

Operating temperatures and pressures for progressing cavity downhole pumps and motors have been generally considered to be limited by the adhesive used to bond the polymeric sleeve to the stator tube or housing. A seal gland of the type disclosed in U.S. Pat. No. 7,407,372 in a downhole pump or motor operates well in steam and high sand content wells where conventional bonding of the polymeric layer to the stator has failed.

Axial grooves in the inside wall of a cylindrical stator tube have been proposed to prevent rotation of the polymeric sleeve due to torque. These grooves are large relative to the stator tube, and were often a quarter or more of the tube width. Other manufacturers have sought to retain the polymeric sleeve on the tube by molding a flange on the end of the sleeve.

Relevant patents include U.S. Pat. Nos. 6,309,195, 7,131,827 and 7,407,372. Other patents of interest include U.S. Pat. Nos. 5,474,432, 4,313,717, 4,029,443, and 7,192,260. Asymmetric contouring of the polymeric liner is disclosed in U.S. Pat. No. 7,083,401.

The disadvantages of the prior art are overcome by the present invention, an improved progressing cavity pump/motor is hereinafter disclosed.

SUMMARY OF THE INVENTION

In one embodiment, a progressing cavity pump/motor comprises a rigid stator housing which has an interior surface, a polymeric layer within the stator housing and having has a radially outer surface in engagement with the stator housing and radially interior profiled surface, and a rotor within the polymeric layer for rotation relative to the stator housing and the polymeric layer. A plurality of circumferentially spaced and axially extending grooves are formed in the interior surface of the stator housing and receive polymeric material therein, the plurality of grooves including one of the necked grooves and intersecting grooves. At least one seal gland adjacent an end of the polymeric layer maintains sealing between the stator housing and the polymeric layer, with the seal gland including a lip axially extending toward a central portion of the polymeric layer.

These and further features and advantages of the present invention will become apparent from the following detailed description, wherein reference is made to the figures in the accompanying drawings.

DETAILED DESCRIPTION OF PREFERRED EMBODIMENTS

Figure 8:
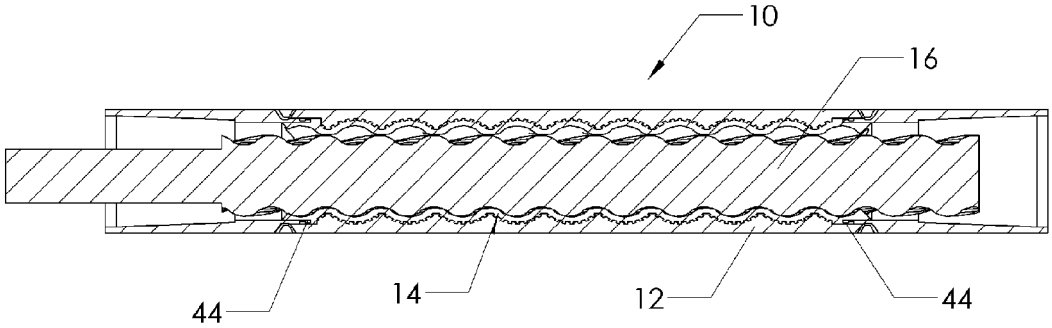
FIG. 8 illustrates a pump/motor with a stator housing and a polymeric layer of a uniform thickness.

FIG. 8 depicts a progressing cavity pump/motor 10 having an outer rigid stator housing 12, a polymeric layer 14 molded within the housing 12 and a rotor 16 which rotates relative to the housing and the polymeric layer. In a downhole pump application, rotor 16 is conventionally rotated by a rod string extending to the surface, and frequently pumps fluid to the surface. In a downhole motor application, fluid pressure from the surface to the motor rotates the rotor 16, which in turn may rotate a drill bit. For a 1:2 geometry with 1 lobe on the rotor and two lobes on the stator, the exterior of the stator housing 12 may be cylindrical, or the stator housing may have a profiled or spiraling exterior configuration, with an exterior stator surface matching the interior stator profile. While a polymeric layer may have a varying thickness, the benefits disclosed herein are particularly well suited for a polymeric layer with a substantially even rubber thickness (ERT). Conventional designs may be used for the rotor which rotates on the radially inward surface of the stator.

Improvements concerning the bonding between the polymeric layer and the stator housing are disclosed. More particularly, a combination of one or more seal glands and grooves in the inner surface of the stator housing reliably grip the elastomer to the stator housing to prevent the elastomer from "peeling" away from the housing. This problem is significantly acute for downhole applications wherein the pump/motor is subjected to high temperature, high pressure, or a combination of high temperature and high pressure. In some applications, the ability of the polymeric layer to withstand high forces is also adversely influenced by the type of downhole fluids and solids (sand) which flow through the pump/motor.

Figure 1:
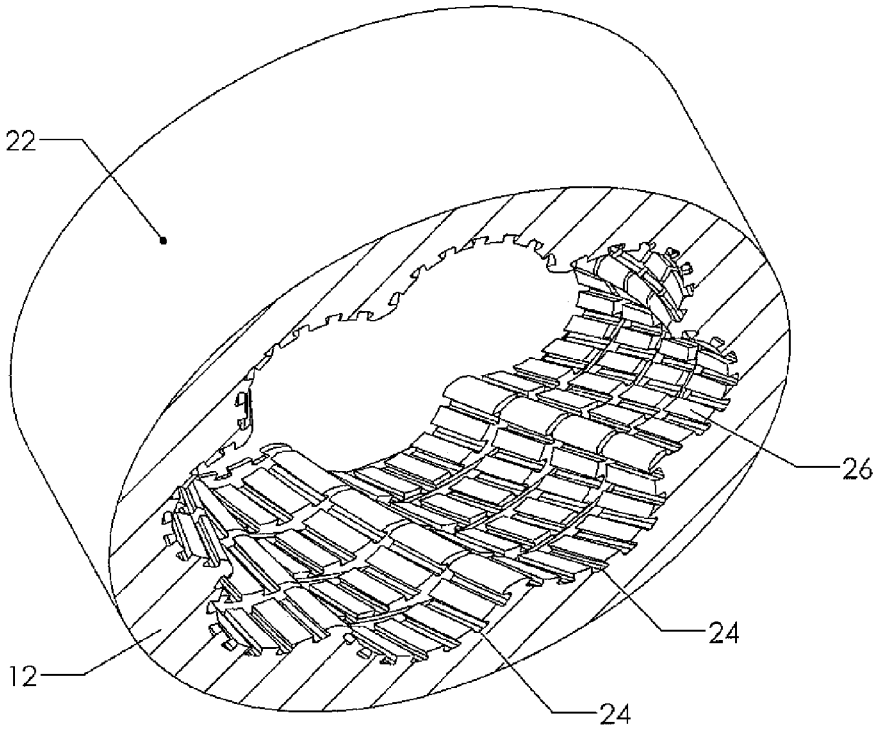
FIG. 1 is a pictorial view illustrating a section of a stator housing with axially extending grooves.

Referring now to FIG. 1, a portion of a stator housing 12 having a cylindrical outer surface 22 is shown. The stator as shown may be manufactured from metal or other materials, and includes eight circumferentially arranged lobes with cooperation with seven lobes on a rotor, although the invention is not limited to a particular stator lobe/rotor lobe combination. A plurality of axially extending grooves 24 are depicted, and it should be understood that the spacing between the grooves is preferably substantially uniform about the perimeter of the inner surface of the stator, and in practice the axially extending grooves could wrap the entire circumference of the inner surface 26 of a stator tube or housing 12.

Figure 2:
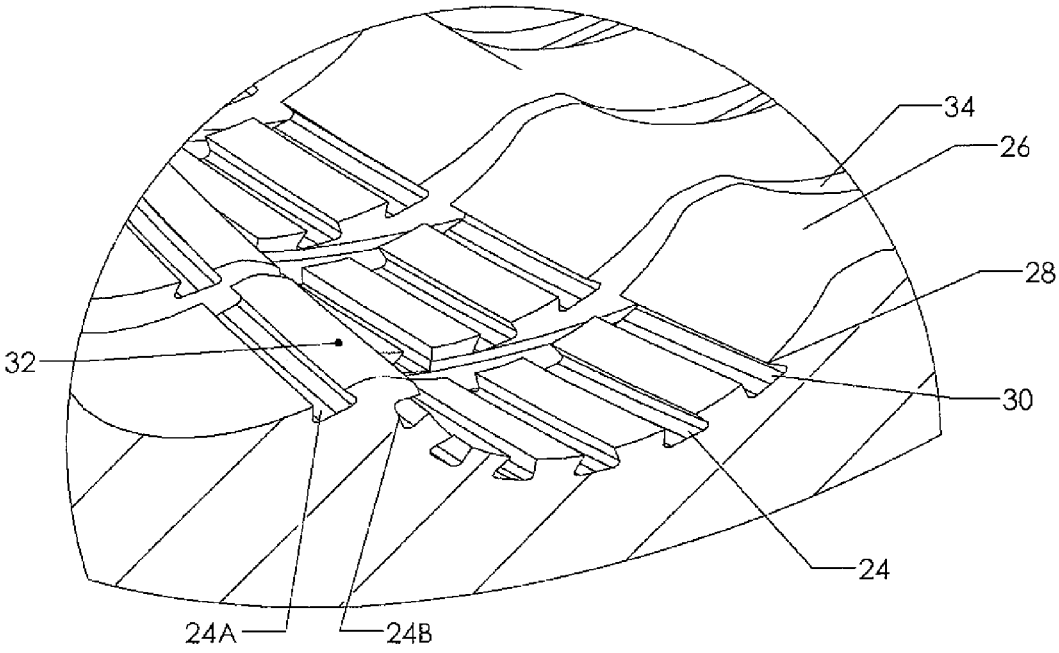
FIG. 2 is an enlarged view of a portion of the stator housing shown in FIG. 1.

FIG. 2 provides further detail for the grooves shown in FIG. 1. It may be understood that each groove is a necked groove, meaning that a neck portion 28 of the groove 24 has a width which is less than the width of a radially deeper portion 30 of the groove. Since the elastomer fills these grooves when molded to the stator housing, neck portion 28 provides a high resistance to the polymeric material in the groove from coming out of the groove. FIG. 2 also depicts a significant feature in that grooves 24A and 24B are provided on opposing sides of radially inward lobe ridge 32, so that the elastomer when it cools is drawn tight into grooves 24A and 24B and slightly stretched across ridge 32. FIG. 2 also depicts grooves 34 which intersect grooves 24 and are discussed subsequently.

Figure 3:
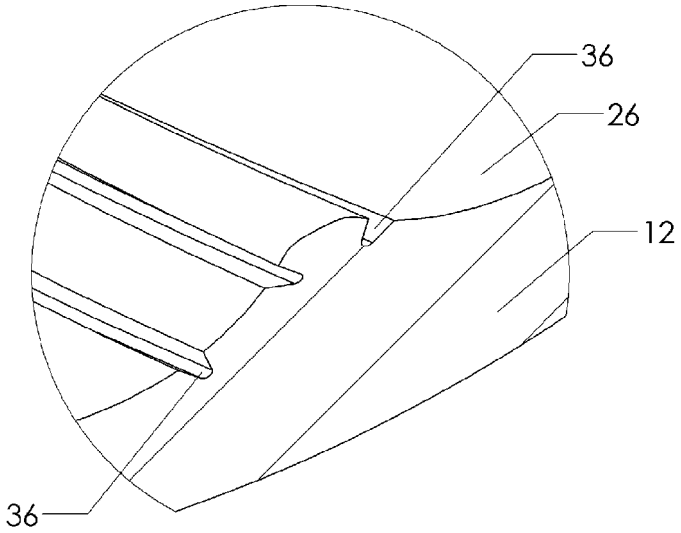
FIG. 3 depicts another embodiment of axially extending grooves in a stator housing.
Figure 4:
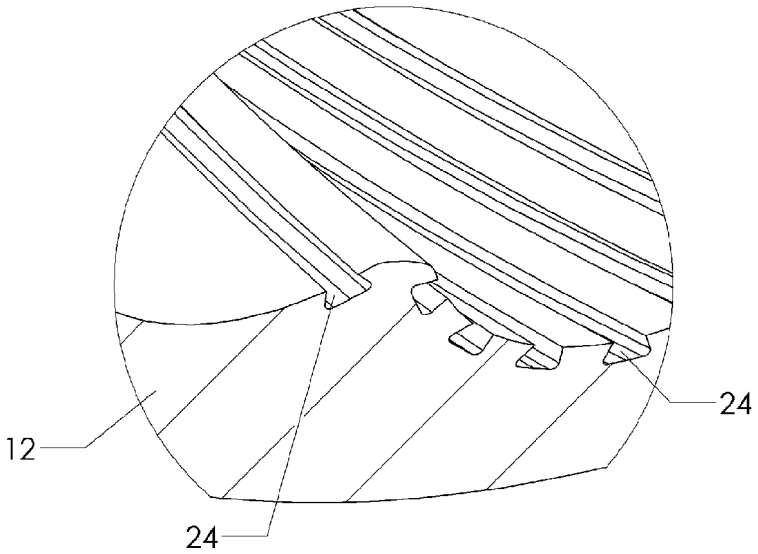
FIG. 4 is another embodiment of a stator housing with axially extending grooves.

FIG. 3 illustrates a portion of an end of the stator housing 12 with conventional "tapered" grooves 36 which each have a width adjacent to interior surface 26 which is as great or greater than portions radially outward from surface 26. Again, only three grooves 36 are shown in FIG. 3, but it should be understood that grooves would similarly be provided circumferentially about the inner surface of the stator 12. FIG. 4 illustrates axially extending grooves 24 which are necked grooves similar to the grooves in FIG. 2.

Figure 5:
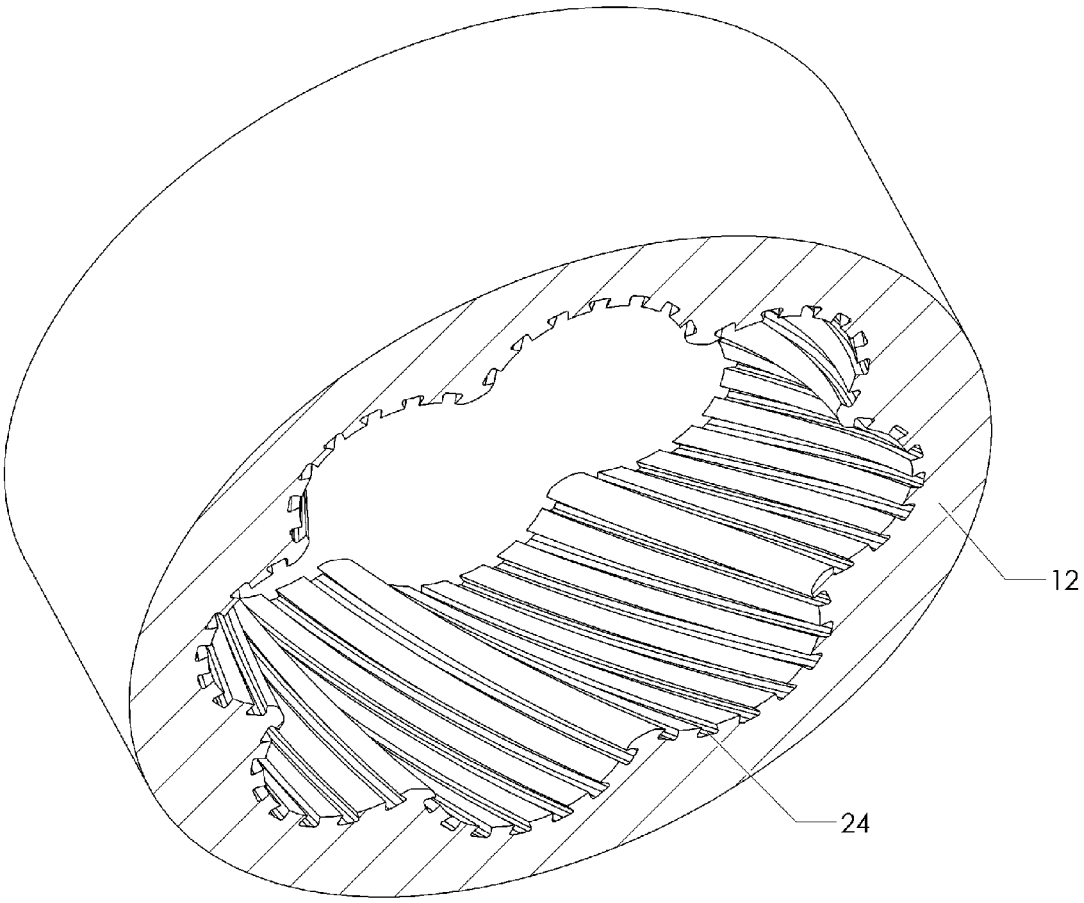
FIG. 5 is a pictorial view of a portion of a stator housing with axially extending grooves.
Figure 6:
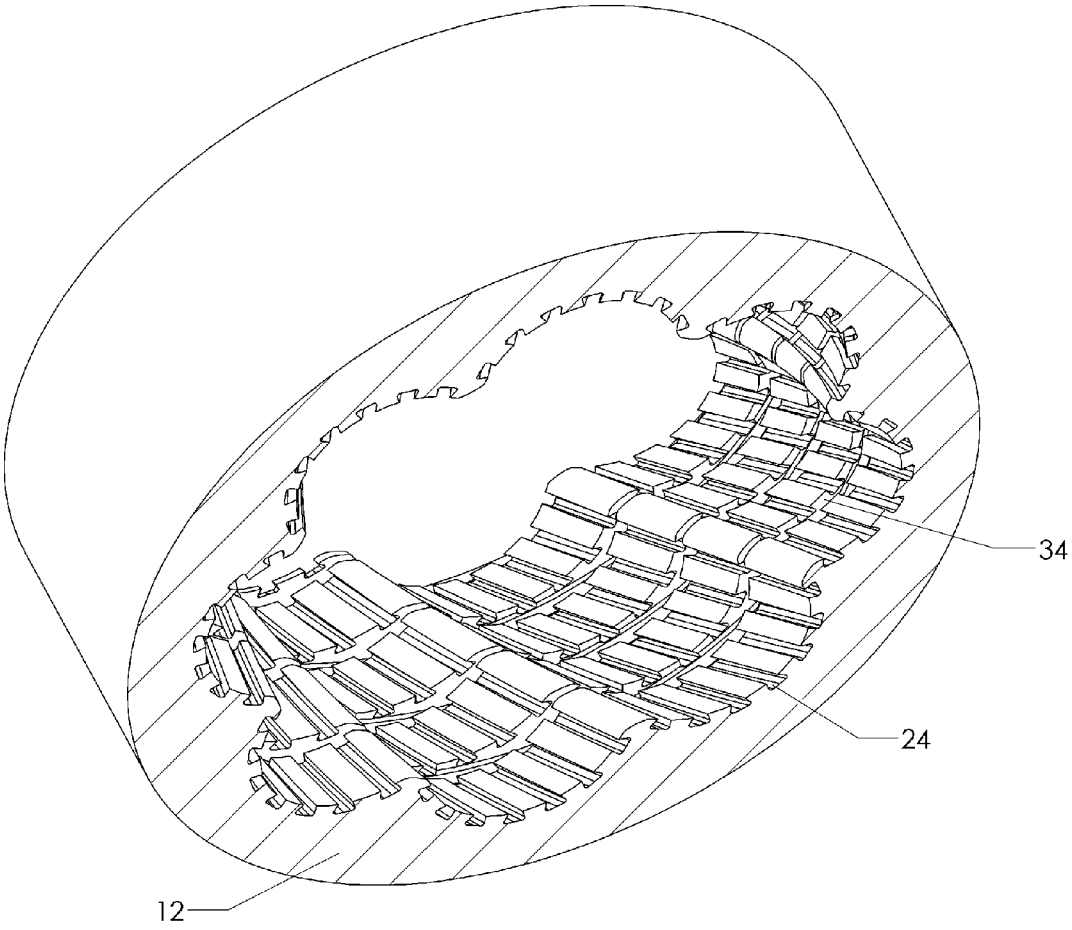
FIG. 6 is an alternative stator housing with axially extending and intersecting grooves.

FIG. 5 depicts a plurality of axially extending grooves 24 which are provided circumferentially about the stator 12. FIG. 6 depicts substantially the same grooves 24, with intersecting grooves 34 added. Particular advantages are obtained by providing both axially extending and intersecting grooves, since the polymeric material secured in one groove resists differently directed forces compared to the forces resisted by a polymeric material positioned in an intersecting groove.

Figure 7:
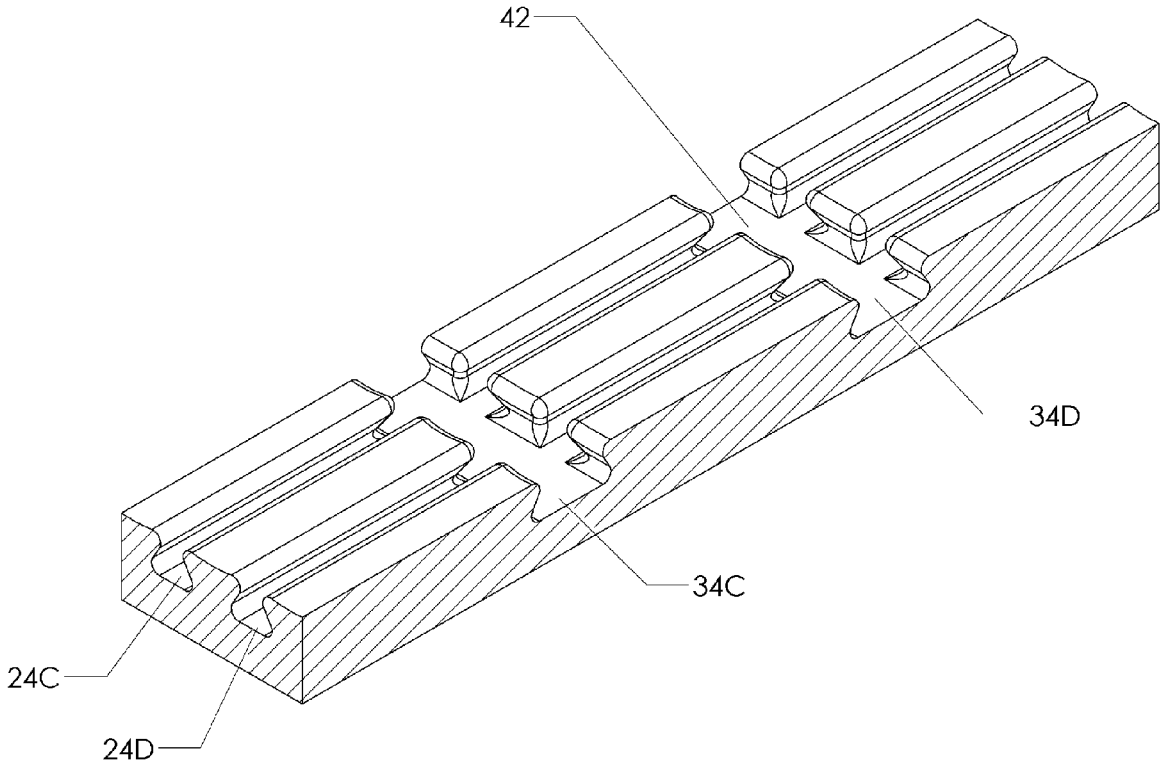
FIG. 7 is a planar representative of intersecting grooves.

The feature of intersecting grooves is shown more clearly in FIG. 7, wherein a section of a stator housing is shown with two axially extending (e.g., spiraling) grooves 24C and 24D and two intersecting grooves 34C and 34D. The cavities 42 formed by the intersecting grooves have a configuration which contributes to the elastomer effectively being locked to the stator housing, so that the polymeric material does not pull away from the stator housing.

FIG. 8 depicts the pump/motor and a plurality of grooves in the inner surface of the stator housing for securing the polymeric material in place. A seal gland 44 is provided adjacent to each end of the polymeric layer for retaining the end of the polymeric layer in place and preventing the polymeric layer from peeling away from the stator housing.

Figure 9:
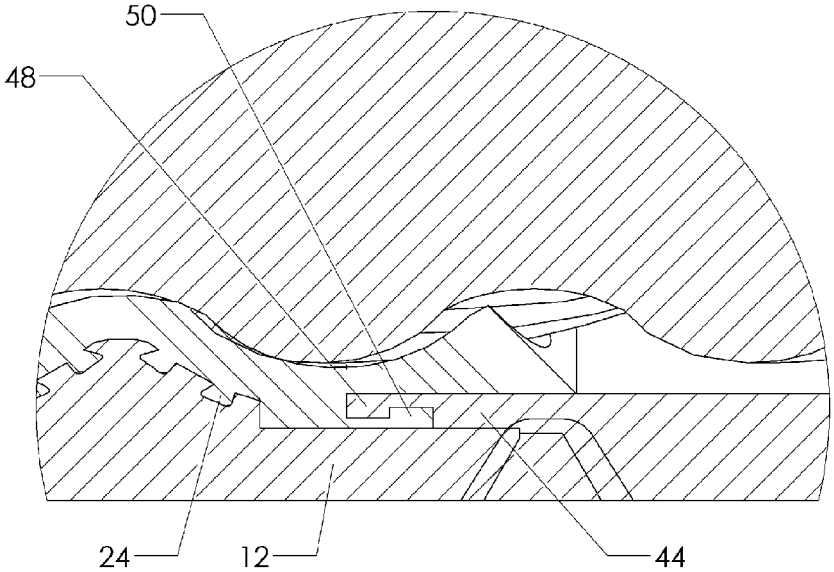
FIG. 9 is a detailed view of one of the seal glands shown in FIG. 8.

FIG. 9 depicts more clearly a polymeric layer with spiraling grooves 24 on an inner surface for the stator housing 12, and seal gland 44 having a projecting member or lip 48 directed toward a center portion of the polymeric layer, and an undercut cavity 50 between the projecting member and the housing surface for securing the polymeric material in place.

The stator housing may be manufactured from a single, heavy wall tube. The concepts disclosed herein may be used on a unitary stator housing manufactured from steel or other materials, including composite materials. For a uniform polymeric thickness application, the desired profile or contour may be cut directly into the stator housing interior wall. A polymeric sleeve of an even rubber thickness may be bonded to the housing to form the stator. The concepts disclosed herein may also be used with a cylindrical stator housing and a polymeric sleeve which has a varying thickness. Also, the concepts disclosed may be used on stator housings with non-circular outer configurations, including a spiraling configuration with an exterior stator surface matching the interior stator profile for 1:2 geometry (1 rotor lobe: 2 stator lobes) since the grooves and the seal glands may still be used to secure the polymeric layer to the stator housing. A seal gland matching the stator profile rather than circular seal gland may thus be provided at an end of the polymeric layer. The features of the present invention may be used with various bonding materials so that the combination of grooves, seal glands, and bonding materials create a mechanical lock between the tube and the polymeric sleeve.

In one embodiment, a plurality of axially extending grooves are each aligned with the stator helix, i.e., the grooves are each shaped in a spiral or helical configuration. A helical groove provides support for the sleeve around the entire perimeter of the stator housing and may maximize resistance of the polymeric sleeve to movement of the housing. A conventional "tapered" groove may be used which has an opening throat which is the same or wider than the radially outer (deeper) portion of the groove. A "necked" groove is a groove wherein the throat adjacent the inner surface housing is narrower than a radially outer (deeper) portion of the groove, so that the groove itself provides mechanical locking of the elastomer to the stator housing. The use of grooves also increases the bonding area between the elastomer and the stator.

In one embodiment, axial movement of the sleeve relative to the stator tube is prevented with the use of grooves which intersect at one or more locations. Intersection can be achieved by the use of different or variable pitch length grooves, grooves with an opposite direction of lead, or grooves generally concentric about the tube axis intersecting axially extending, spiraling grooves. Necked grooves or tapered grooves may be used, particularly with intersecting grooves.

A stator housing or tube for a progressing cavity pump/motor preferably includes axially extending grooves on its inner surface, which may be spiraling grooves which follow the contour of the stator lobes. The stator housing may have a circular cross-sectional configuration, a spiraling oval cross-sectional configuration, or a multi-lobed cross-sectional configuration. In such cases, the stator housing will have a nominal or "standard" wall thickness. The groove depth preferably is from 5% to 25% of the wall thickness, which provides a sizable cross-sectional cavity for the elastomer to hold the elastomer in place, while not significantly reducing the strength of the stator housing.

The grooves on the inner surface of the stator housing are also elongated in that each groove has a length significantly greater than its width. Continuous grooves may be formed along substantially the entire length of the stator housing, or a foot long axially extending groove may be formed, followed by several inches of no groove, followed by a continuation foot long axially extending groove, etc. Grooves in the interior surface of the stator may have a dovetailed cross-sectional configuration, with the sidewalls projecting outward from the groove centerline so that the throat of the groove is less than a deeper, wider part of the groove. The groove alternatively may have one outwardly slanted side wall, and a "straight" side wall which is substantially perpendicular to the interior surface of the stator. In another alternative, both the side walls of the groove may be tapered outwardly, but at different angles relative to a centerline of the groove. In yet another embodiment, the groove has a generally truncated oval configuration, so that the throat is narrower than the widest part of the grooves, and the sidewalls of the groove extend downward and away from the groove centerline to form a curvilinear groove bottom with matching side walls.

Either axially extending grooves which do not match the contour of the stator lobes or intersecting grooves within a plane substantially perpendicular to a central axis of the stator may be a substantially uniform depth from a centerline of the pump/motor. In the case of the intersecting groove positioned within a plane perpendicular to centerline of the pump/motor, for example, each groove may cut through peaks of the stator lobes and "run out" before encountering the deep valley between the lobes, so that intersecting grooves may be provided on each side of a lobe, but not in the valley between the lobes. Similarly, axially extending grooves which do not match the profile of the stator may have a substantially uniform depth from the central axis of the pump/motor. In this case, the groove may extend axially downward in a spiraling manner and cut through a right side, a top, and a left side of the stator lobe, and the groove simply runs out onto the stator interior surface so that it is not formed in the deep valley between the lobes. A groove in the deep valley may be easily formed as an axially extending groove which matches the profile of the stator interior.

The circumferential spacing between the grooves is relatively short, and the lands between the grooves (interior surface of stator housing not having a groove) for a preferred embodiment may occupy from one to four times the surface area of the groove throats. This allows grooves to fill with the elastomer about a large portion of the circumference of the stator, thereby firmly securing the polymeric material in place.

A currently preferred groove geometry along the interior surface of the stator housing may conform to the following parameters: (1) a cross-section of the stator in a plane perpendicular to the central axis at the pump/motor may include two or more grooves in the valley between the stator lobe peaks, so that at least two grooves will be present in each valley to hold the elastomer in place; (2) a preferred ratio of groove throat to the widest part of the necked groove is between 45:100 and 95:100; and (3) the angle formed between a symmetrical or nonsymmetrical groove sidewall relative to the cross-section groove centerline between the groove throat and widest part of the groove is between 0° and 26°.

The technology presented herein improves the bond strength between the polymeric sleeve and tube (stator housing) by increasing the bond surface area between the sleeve (polymeric layer) and tube, and increasing the mechanical locking forces between the sleeve and tube. This groove technology preferably locks the polymeric sleeve to the tube by increasing the adhesive contact surface and thus the bond strength between the sleeve and the tube. The addition of helical grooves on the tube interior increases the resistance of the sleeve to move axially relative to the tube. The addition of intersecting grooves on the tube increases the resistance of the sleeve to move axially relative to the tube. The addition of helical grooves on the tube increases the resistance of the sleeve to rotate relative to the tube. The addition of intersecting grooves on the tube increases the resistance of the sleeve to rotate relative to the tube. The addition of helical grooves on the tube increases the resistance of the sleeve to move in the radial direction relative to the tube. The addition of intersecting grooves on the tube increases the resistance of the sleeve to move in the radial direction relative to the tube. The addition of helical necked grooves on the tube increases the resistance of the sleeve to move in the radial direction relative to the tube. The addition of intersecting necked grooves on the tube increases the resistance of the sleeve to move in the radial direction relative to the tube. This groove technology mechanically locks the sleeve to the tube by providing continuous, intersecting groove locking mechanism about the internal surface of the tube and maintaining a retention force normal to the tube surface even when this force does not act through the axis of the tube, i.e., even when the tube surface is not cylindrical. The mechanical lock design disclosed herein eliminates the need for adhesive while retaining the field proven ERT tube design, although an adhesive may still be used. The thermal, mechanical, and chemical limitations of the stator housing are now functions of only the elastomer.

The term "polymeric" as used herein for the layer 14 is intended to include polymeric and/or plastic materials suitable for use as the layer molded to the housing 12 of a pump/motor.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A progressing cavity pump/motor, comprising:

a stator housing having an interior surface, a plurality of axially-extending and necked grooves formed in the interior surface of the stator housing, and a plurality of necked grooves also formed in the interior surface of the stator housing and having a circumferential component, wherein the plurality of axially-extending and necked grooves intersect the plurality of necked grooves having a circumferentially-extending component each of the axially-extending and necked grooves and each of the necked grooves having the circumferentially-extending component being provided with a neck portion having a width which is less than a width of a radially deeper portion of the necked groove;

a polymeric layer molded onto the interior surface of the stator housing and having a radially interior surface and a plurality of radially outwardly projecting portions received within the axially extending and necked grooves of the stator housing and also within the necked grooves having the circumferentially-extending component, each of the radially outwardly projecting portions of the polymeric layer having a radially inwardly disposed width corresponding to the neck portion width of the necked grooves and a radially outwardly disposed width corresponding to the width of the radially deeper portion of the necked grooves;

a rotor radially interior of the polymeric layer and rotatable relative to the stator housing and the radially interior surface of the polymeric layer disposed therein; and wherein the plurality of radially outwardly projecting portions of the polymeric layer are molded within the necked grooves formed in the interior surface of the stator housing to provide an interlocking fit to secure the polymeric layer in its molded position within the stator housing.

2. The progressing cavity pump/motor of claim 1, wherein seal glands are provided at opposed ends of the polymeric layer.

3. The progressing cavity pump/motor of claim 1, wherein the radially interior surface of the stator housing is profiled to engage a radially exterior portion of the polymeric layer; and the polymeric layer, between the radially outwardly projecting portions, has a uniform thickness.

4. The progressing cavity pump/motor of claim 1, wherein the plurality of necked grooves having a circumferentially-extending component include a plurality of necked grooves each forming a spiral.

5. The progressing cavity pump/motor of claim 1, wherein the plurality of axially extending and necked grooves are spaced about the stator housing interior surface.

6. The progressing cavity pump/motor of claim 1, wherein the interior surface of the stator is cylindrical before forming the grooves.

7. A progressing cavity pump/motor, comprising:

a stator housing having an interior surface with a plurality of axially-extending and necked grooves formed in the interior surface of the stator housing, each of the necked grooves having a neck portion width adjacent to a radially interior surface of the groove which is less than a width of a radially deeper portion of the groove;

a plurality of necked grooves formed in the interior surface of the stator housing that have a circumferential component and that intersect the axially-extending and necked grooves, each of the necked grooves having a circumferential component also having a neck portion width adjacent to a radially interior surface of the groove which is less than a width of a radially deeper portion of the groove;

a polymeric layer molded onto the interior surface of the stator housing and having a plurality of radially outwardly disposed projections received into the plurality of axially-extending and necked grooves in the interior surface in the stator housing and also having a plurality of outwardly disposed projections received into the plurality of necked grooves having the circumferential component that intersect the axially-extending and necked grooves, each of the plurality of radially outwardly disposed projections of the polymeric layer having a proximal portion, with a width corresponding to the width of the necked portion of the necked groove into which the projection is received, and a distal portion, with a width corresponding to the width of the radially deeper portion of the necked groove into which the projection is received, to provide an interlocking fit between each of the radially-outwardly disposed projections of the polymeric layer and the necked grooves of the interior surface of the stator housing into which the radially-outwardly disposed projections are received; and a rotor rotatably received within an interior of the polymeric layer that is molded into the interior surface of the stator housing.

8. The progressing cavity pump/motor of claim 7, wherein the interior surface of the stator housing is profiled to engage with an exterior portion of the polymeric layer; and the polymeric layer has a uniform thickness.

9. The progressing cavity pump/motor of claim 7, wherein the plurality of axially-extending and necked grooves are spaced about a perimeter of the stator housing interior surface.

10. A method of manufacturing a pump/motor, comprising:

providing a stator housing having an interior surface;

forming a plurality of axially-extending and necked grooves in the interior surface of the stator housing;

forming a plurality of necked grooves having a circumferential directional component in the interior surface of the stator housing to intersect the plurality of axially-extending and necked grooves;

molding a polymeric layer having a radially outer surface in engagement with the interior surface in the stator housing to thereby form a plurality of radially-outward projections of the polymeric layer received into the axially-extending and necked grooves formed in the interior surface of the stator housing and also received into the necked grooves having the circumferential component which intersect the axially-extending and necked grooves; and providing a rotor within an interior of the stator housing, and within the polymeric layer molded therein, to rotate relative to the stator housing and relative to the polymeric layer molded therein;

wherein each of the radially outward projections of the polymeric layer has a proximal width corresponding to the width of the necked portion of a necked groove in the interior surface of the stator housing into which the projection is received;

wherein each of the radially outward projections of the polymeric layer has a distal width corresponding to a width of a radially deeper portion of the necked groove in the interior surface of the stator housing into which the projection is received; and wherein each of the radially-outward projections of the polymeric layer is molded into a necked groove in the interior surface of the stator housing into which the projection is received to provide an interlocking relationship between the projection and the necked groove.

11. The method of claim 10, further comprising:

providing a first seal gland adjacent a first end of the polymeric layer to maintain a seal between an adjacent first end of the stator housing and the first end of the polymeric layer, the first seal gland including a lip axially extending toward a central portion of the polymeric layer; and providing a second seal gland adjacent to a second end of the polymeric layer that is opposite to the first end of the polymeric layer to maintain a seal between an adjacent second end of the stator housing and the second end of the polymeric layer, the second seal gland including a lip axially extending toward the central portion of the polymeric layer.

12. The method of claim 10, wherein the interior surface of the stator housing is profiled to engage an exterior portion of the polymeric layer; and the polymeric layer has a uniform thickness between the radially-outward protrusions.

13. The method of claim 10, wherein each of the plurality of axially-extending and necked grooves include a necked portion adjacent to a radially interior surface of the necked groove with a width less than a width of the radially deeper portion of the necked groove.

14. The method of claim 13, wherein each of the plurality of axially extending and necked grooves intersects a plurality of necked grooves having a circumferential component.

15. The method of claim 10, wherein the plurality of axially-extending grooves are spaced about a perimeter of the stator housing interior surface.

16. The method of claim 10, wherein the interior surface of the stator housing, is cylindrical; and the polymeric layer has a non-uniform thickness between the radially outward protrusions to sealably engage at least one lobe on the rotatable rotor received within the interior of the stator housing and the polymeric layer.

* * * * *